US011220779B2

(12) United States Patent
Bicic

(10) Patent No.: US 11,220,779 B2
(45) Date of Patent: Jan. 11, 2022

(54) DOOR-LOCK WITH DOOR SENSING

(71) Applicant: Illinois Tool Works Inc., Glenview, IL (US)

(72) Inventor: Bojan Bicic, Slap Ob Idrijci (SI)

(73) Assignee: Illinois Tool Works Inc., Glenview, IL (US)

( * ) Notice: Subject to any disclaimer, the term of this patent is extended or adjusted under 35 U.S.C. 154(b) by 668 days.

(21) Appl. No.: 16/078,255

(22) PCT Filed: Jan. 30, 2017

(86) PCT No.: PCT/US2017/015606
§ 371 (c)(1),
(2) Date: Aug. 21, 2018

(87) PCT Pub. No.: WO2017/155627
PCT Pub. Date: Sep. 14, 2017

(65) Prior Publication Data

US 2019/0048619 A1 Feb. 14, 2019

(30) Foreign Application Priority Data

Mar. 8, 2016 (IT) ..... 102016000024293

(51) Int. Cl.
*D06F 39/14* (2006.01)
*D06F 49/00* (2006.01)
(Continued)

(52) U.S. Cl.
CPC ..... *D06F 39/14* (2013.01); *D06F 49/003* (2013.01); *E05B 17/2007* (2013.01);
(Continued)

(58) Field of Classification Search
CPC .... D06F 39/14; D06F 49/003; E05B 17/2007; E05B 47/0603; E05B 2047/0068; E05Y 2900/30; E05Y 2900/31
See application file for complete search history.

(56) References Cited

U.S. PATENT DOCUMENTS

2007/0209411 A1* 9/2007 Lim ..... D06F 34/20 70/263
2017/0145613 A1* 5/2017 Choi ..... E05B 17/2007
2019/0292714 A1* 9/2019 Bicic ..... D06F 39/14

FOREIGN PATENT DOCUMENTS

CN 102168351 A 8/2011
CN 102444336 A 5/2012
(Continued)

*Primary Examiner* — Kristina R Fulton
*Assistant Examiner* — James Edward Ignaczewski
(74) *Attorney, Agent, or Firm* — Boyle Fredrickson, S.C.

(57) ABSTRACT

A door-lock for household appliances, comprising a casing (12) having an opening (14) for the insertion of a hook (15) carried by a door of said household appliance, a cam (16) rotatable relative to the casing (12) about a first axis (A) between a retaining position and a release position, wherein in the retaining position said cam (16) is adapted to lock said hook (15) in a closed door position, a locking slider (20) cooperating with said cam (16) and movable between an unlocking position and a locking position, wherein in the locking position the slider (20) locks the cam (16) in the retaining position, a locking pin (28) for locking the locking slider (20) in the locking position, a door sensing slider (32) movable between an open door position and a closed door position, the door sensing slider (32) having an abutment portion (36) including a top surface (38) and an inclined surface (40) and a door sensing pin (46) elastically biased against said abutment portion (36) of the door sensing slider (32), wherein in the open door position of the door sensing slider (32) the door sensing pin (46) is in contact with said
(Continued)

top surface (38) and in the closed door position of the door sensing slider (32) the door sensing pin (46) is in contact with said inclined surface (40).

9 Claims, 8 Drawing Sheets

(51) Int. Cl.
*E05B 17/20* (2006.01)
*E05B 47/06* (2006.01)
*E05B 47/00* (2006.01)

(52) U.S. Cl.
CPC ... *E05B 47/0603* (2013.01); *E05B 2047/0068* (2013.01); *E05Y 2900/30* (2013.01); *E05Y 2900/312* (2013.01)

(56) References Cited

FOREIGN PATENT DOCUMENTS

| | | | | | |
|---|---|---|---|---|---|
| CN | 104929438 | A | | 9/2015 | |
| CN | 204608413 | U | | 9/2015 | |
| DE | 20 2015 100627 | | | 4/2015 | |
| DE | 202015100627 | U1 | * | 4/2015 | ..... D06F 37/28 |
| DE | 10 2015 201944 | | | 9/2015 | |
| DE | 102015201944 | A1 | * | 9/2015 | ..... E05B 47/0603 |
| EP | 2 087 829 | | | 8/2009 | |
| KR | 101054410 | B1 | | 11/2005 | |
| WO | WO-2013081289 | A1 | * | 6/2013 | ..... B63H 25/42 |
| WO | 2015/140306 | | | 9/2015 | |
| WO | 2015/189668 | | | 12/2015 | |
| WO | WO-2015187223 | A1 | * | 12/2015 | ..... D06F 39/14 |

* cited by examiner

DOOR-LOCK WITH DOOR SENSING

FIELD OF THE INVENTION

The present invention relates to a door-lock for household appliances such as washing machines, dryers, washing-drying machines and the like.

BACKGROUND OF THE INVENTION

A door-lock for household appliances is an electro-mechanical device adapted to lock in a closed position the door of a machine. In certain cases, the door-lock is also provided with a door sensing circuit which provides information on the open/closed state of the door.

WO2013181289 discloses a door-lock for appliances including:

a casing having an opening for the insertion of a hook carried by the door of the appliance, a cam rotatable relative to the housing about an axis of rotation between a retaining position and a release position, wherein in the retaining position the cam is adapted to lock the hook in a closed door position, a locking slider cooperating with the cam and movable between an unlocking position and a locking position, wherein in the unlocking position the cam is free to rotate around said axis of rotation and wherein in the locking position the locking slider locks the cam in the retaining position, an electromagnetic actuator including a locking pin adapted to lock said locking slider in the locking position, and a door sensing pin which cooperates with a door sensing slider that is movable relative to the housing between an open door position and a closed door position.

A similar solution is also described in the document WO2013011528.

In the known solutions detection of the open/closed state of the door takes place in a constant position of the door. Recently, appliance manufacturers require the ability to detect in a differentiated manner the open/closed state of the door during closing and opening the door. In particular, it is required that the open door state during the opening of the door is detected with a certain hysteresis as compared to the door open state during the closing of the door.

DE-A-10 2015 201 944 of the same Applicant discloses a door-lock for household appliances, including:

a casing having an opening for the insertion of a hook carried by a door of a household appliance, a cam rotatable relative to the casing about a first axis between a retaining position and a release position, wherein in the retaining position cam is adapted to lock said hook in a closed door position, a slider cooperating with said cam and movable between an unlocking position and a locking position, wherein in the locking position the slider locks the cam in the retaining position, a locking pin adapted to lock the slider in the locking position, a door sensing device including a door sensing pin movable between an open door position and a closed door position, wherein the slider carries a hysteresis element movable relative to the slider between a first position and a second position and elastically pushed toward said first position, wherein the hysteresis element has a flat surface, an inclined ramp that ends on the flat surface and a step between the flat surface and the inclined ramp, wherein the door sensing pin is urged into contact with the element of hysteresis, wherein during the movement of the slider from the unlocking position to the locking position the hysteresis element is in the first position and the door sensing pin rests on the flat surface of the hysteresis element and wherein during movement of the slider from the locking position to the unlocking position the door sensing pin abuts on said inclined ramp and maintains the hysteresis element in the second position.

A drawback of the solution known from DE-A-10 2015 201 944 is that it cannot be used on certain existing type of door locks.

OBJECT AND SUMMARY OF THE INVENTION

The object of the present invention is to provide a door-lock with an improved door sensing device with hysteresis function, which can be applied on existing types of door locks.

According to the present invention, this object is achieved by a door-lock having the characteristics forming the subject of claim 1.

The claims form an integral part of the teachings given in relation to the invention.

BRIEF DESCRIPTION OF THE DRAWINGS

The present invention will now be described in detail with reference to the accompanying drawings, given purely by way of non-limiting example, in which.

DETAILED DESCRIPTION

Figure 1:
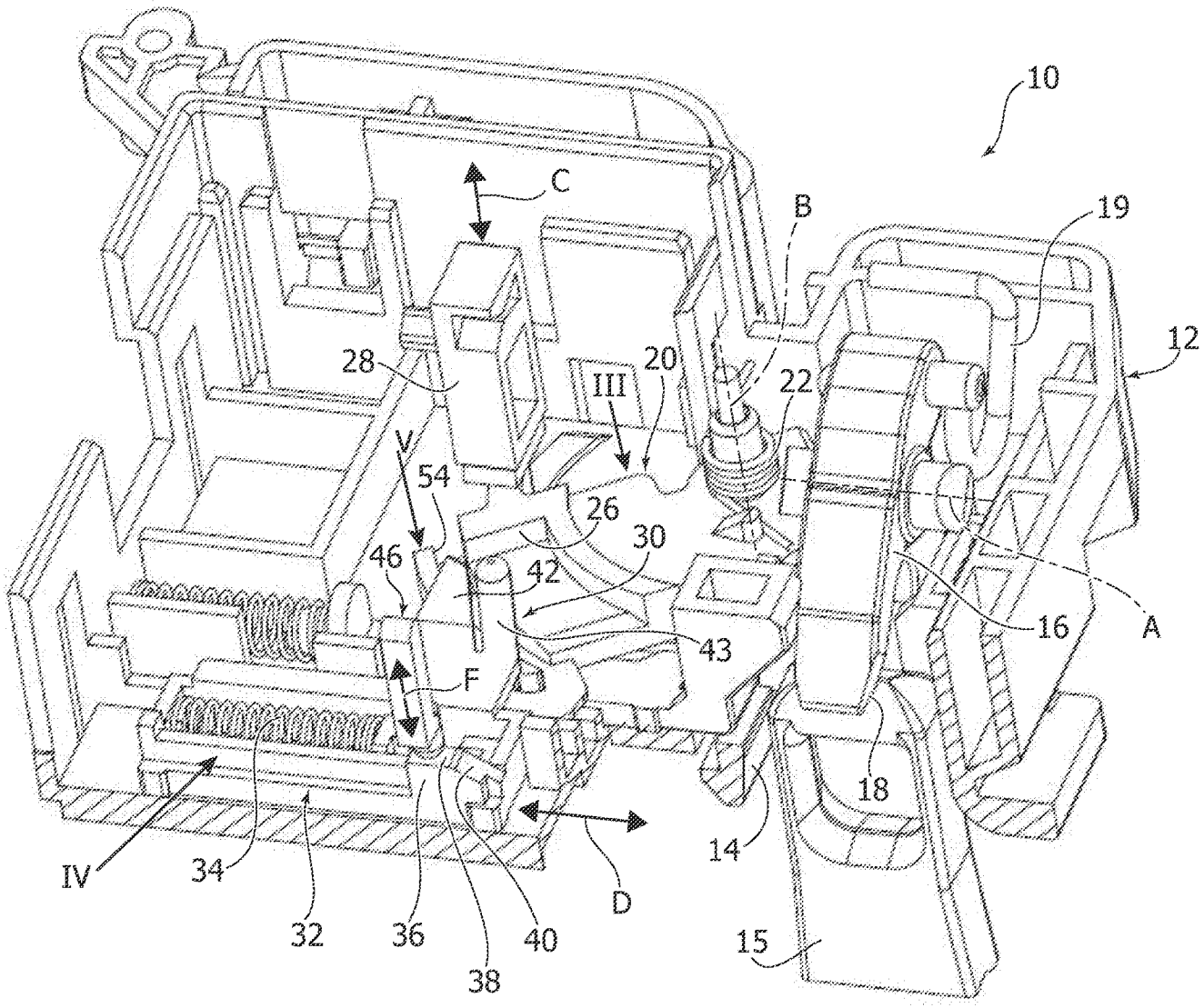
FIGS. 1 and 2 are partially sectioned perspective view of a door-lock according to the present invention in an open door position and in a closed door position, respectively.

With reference to FIG. 1, numeral 10 indicates a door-lock for household appliances according to the present invention. The door-lock 10 comprises a casing 12 having an opening 14 for the insertion of a hook 15 carried by the door of the appliance.

The door-lock 10 includes a cam 16 rotatable relative to the housing 12 about a first axis A between a retaining position and a release position. The cam 16 has an engagement portion 18 which cooperates with the hook 15.

The cam 16 is associated with a spring 19 having a bi-stable function. When the door of appliance is in the open position the spring 19 pushes the cam 16 to the release position and when the door of appliance is closed the spring 19 pushes the cam 16 to the retaining position.

When the hook 15 penetrates into the opening 14 of the casing 12 as a result of the closing of the door, the hook 15 engages the engagement portion 18 of the cam 16 and the cam 16 rotates about axis A from the release position to the retaining position.

The door-lock 10 comprises a locking slider 20 which is rotatable relative to the casing 12 about a second axis B oriented at 90° with respect to the first axis A. The locking slider 20 is rotatable about axis B between a locking position and an unlocking position. A spring 22 biases the locking slider 20 towards the locking position.

Figure 2:
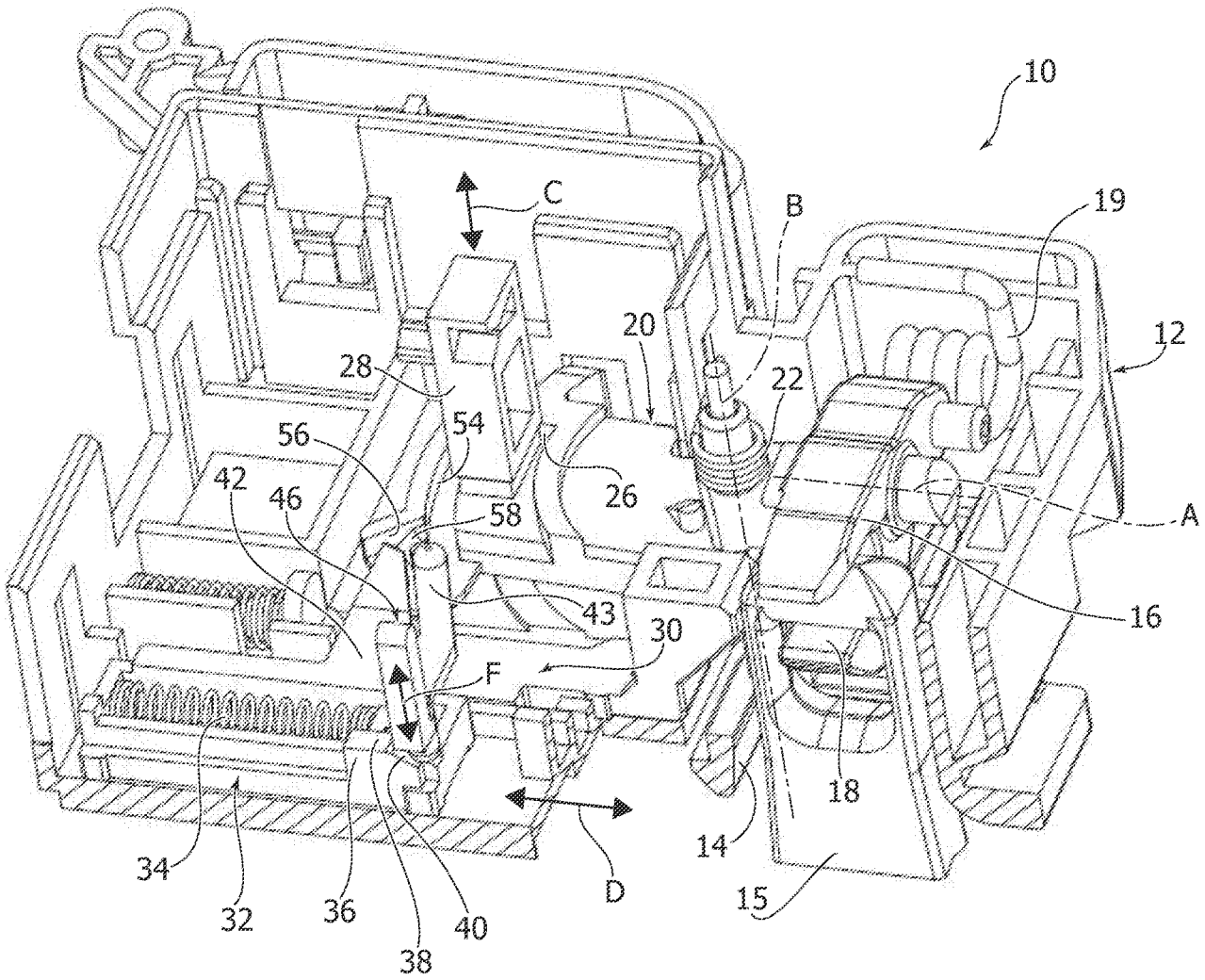
Figure 3:
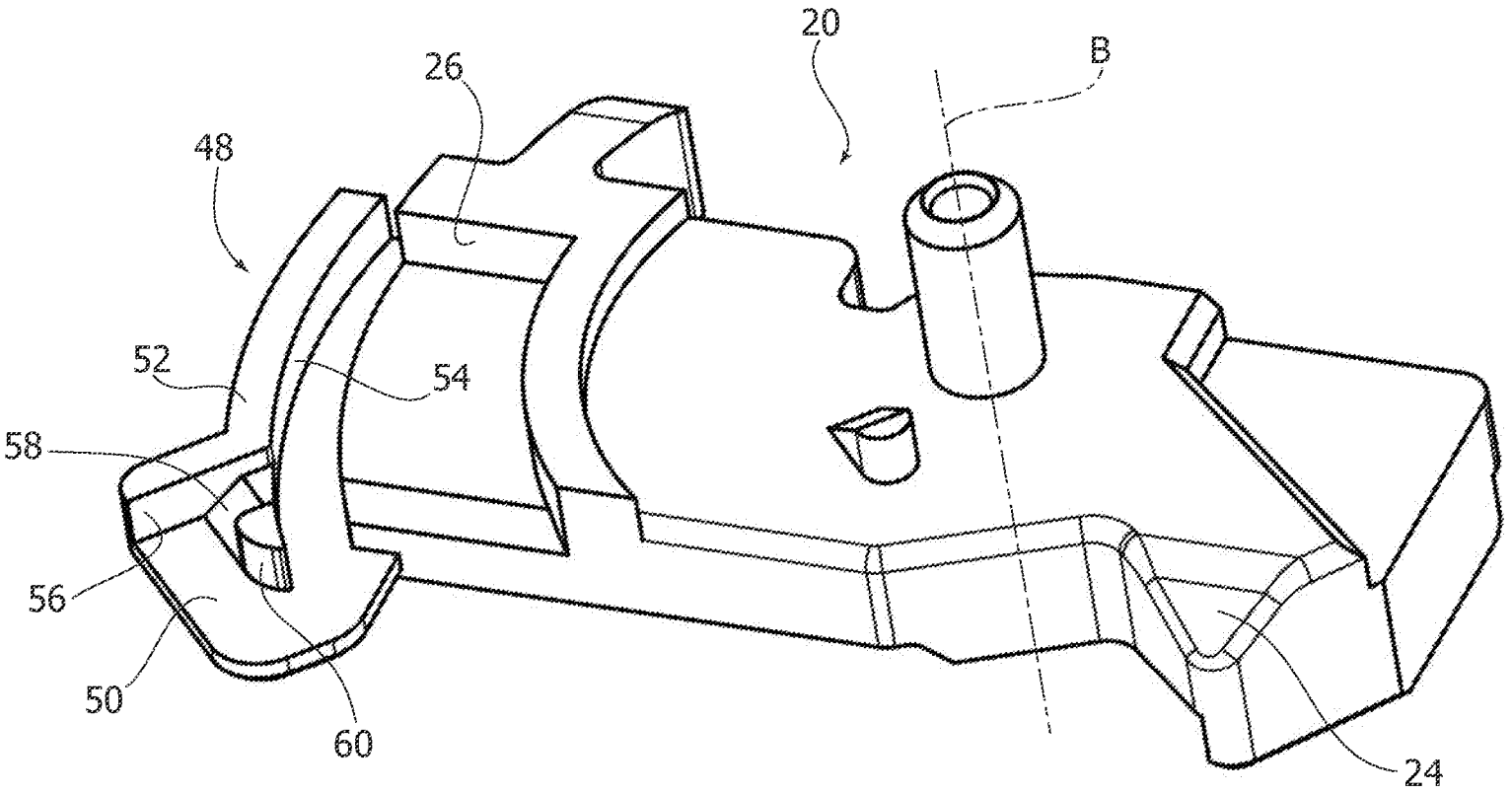
FIG. 3 is a perspective view of the locking slider indicated by the arrow III in FIG. 1.

With reference to FIG. 3, the locking slider 20 has a first lock portion 24 and a second lock portion 26, arranged on opposite sides with respect to the second axis of rotation B. The first lock portion 24 is intended to contact the cam 16 to lock the cam 16 in the retaining position. The second lock portion 26 of the locking slider 20 is designed to contact a locking pin 28, shown in FIGS. 1 and 2. The locking pin 28 is movable in a rectilinear direction C parallel to the second axis B and is movable between a release position and locking position. When the locking pin 28 engages the second lock portion 26 of the locking slider 20, the locking slider 20 is locked in the lock position. The locking pin 28 is controlled by an electromagnetic actuator (not shown) in the manner described in WO2013181289.

Figure 4:
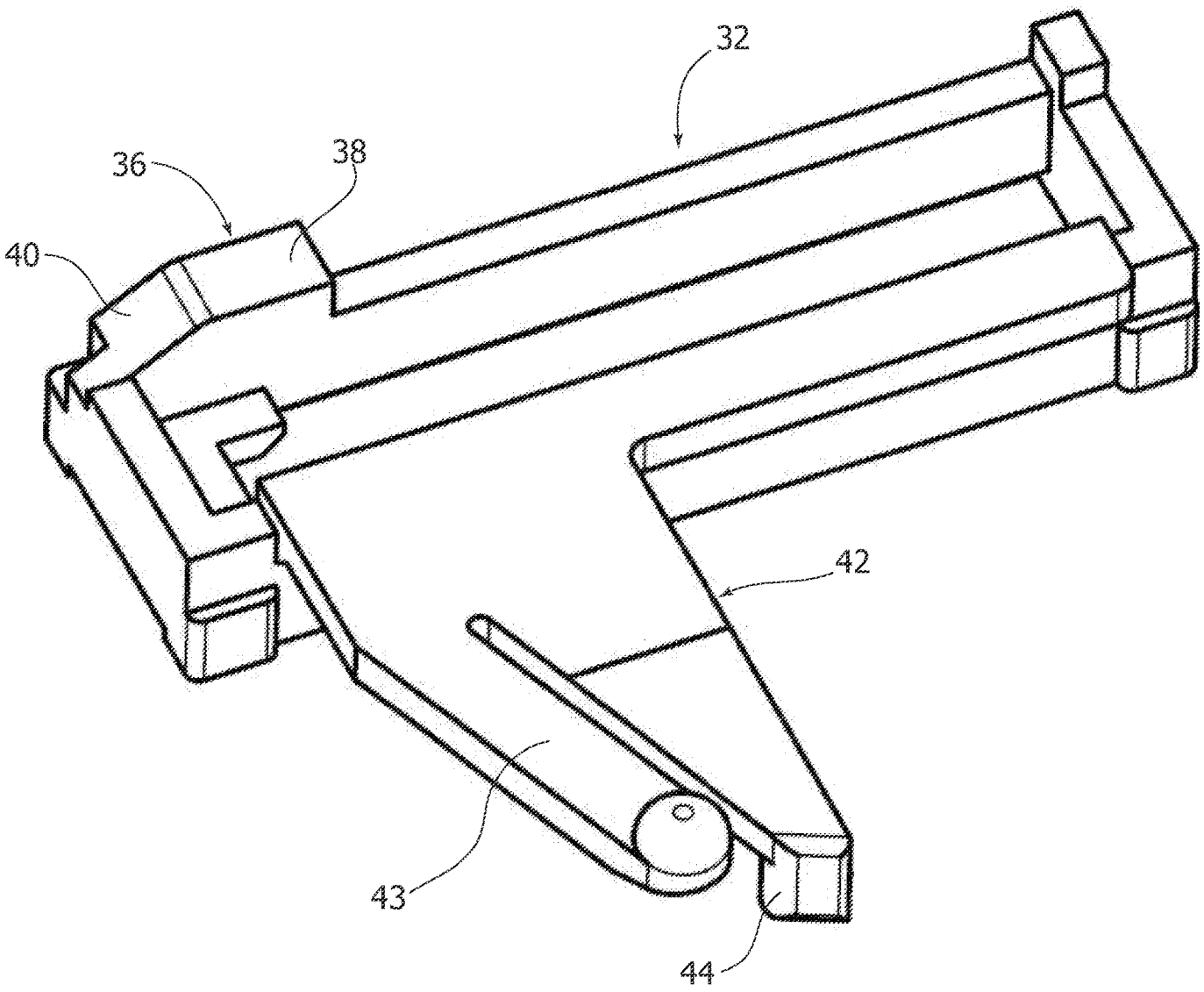
FIG. 4 is a perspective view of the door sensing slider indicated by the arrow IV in FIG. 1, and FIGS. 5-8 are perspective views of the parts indicated by the arrow V in FIG. 1 showing the sequence of operation of the door sensing device.

With reference to FIGS. 1 and 2, the door-lock 10 comprises a door sensing device 30 adapted to detect the open/closed state of the door. The door sensing device 30 comprises a door sensing slider 32, movable in the casing 12 along a rectilinear direction D between an open door position shown in FIG. 1 and a closed door position shown in FIG. 2. A spring 34, for instance a helical compression spring, is set between the casing 12 and the door sensing slider 32 and biases the door sensing slider towards the closed door position. The door sensing slider 32 has an integral abutment portion 36 having a top surface 38 and an inclined surface 40. With reference to FIG. 4, the door sensing slider 32 has an integral arm 42 projecting in a direction orthogonal to the direction D. A projection 44 is formed at a distal end of the arm 42. The projection 44 projects below a lower surface of the arm 42. The arm 42 has an elastically deformable portion 43.

The door sensing device 30 comprises a door sensing pin 46 which is movable in the casing 12 along a rectilinear direction F orthogonal to the direction D between a raised position corresponding to the open door position of the door sensing slider 32 and a lowered position corresponding to the closed door position of the door sensing slider 32. The door sensing pin 46 cooperates with a door sensing switch (not shown) which elastically biases the door sensing pin 46 towards the abutment portion 36. In the open door position of the door sensing slider 32 the door sensing pin 46 abuts on the top surface 38 of the abutment portion 36 and keeps the door sensing switch in an open state. In the closed door position of the door sensing slider 32 the door sensing pin 46 abuts on the inclined surface 40 of the abutment portion 36 and allows the door sensing switch to switch to a closed state. A door sensing switch of this type is disclosed in WO2013181289.

With reference to FIG. 3, the door sensing device 30 comprises a retaining portion 48 integrally formed on the locking slider 20 in the vicinity of the second lock portion 26. The retaining portion 48 has a bottom surface 50, a top surface 52, a first side surface 54 and a second side surface 56 extending between the bottom surface 50 and the top surface 52. The second side surface 56 extends radially from the first side surface 54. The retaining portion 48 also comprises an inclined ramp 58 which connects the bottom surface 50 to the first side surface 54. The inclined surface 58 is set between the second side surface 56 and a rounded surface 60 which projects from the bottom surface 50 at an end of the first side surface 54. The projection 44 of the door sensing slider 32 cooperates with the first side surface 54, the second side surface 56 and the inclined ramp 58 to provide a hysteresis of the door sensing device 30 as will be disclosed below.

The operation of the door-lock 10 according to the present invention will now be described with reference to FIGS. 1, 2 and 5-8.

Figure 5:
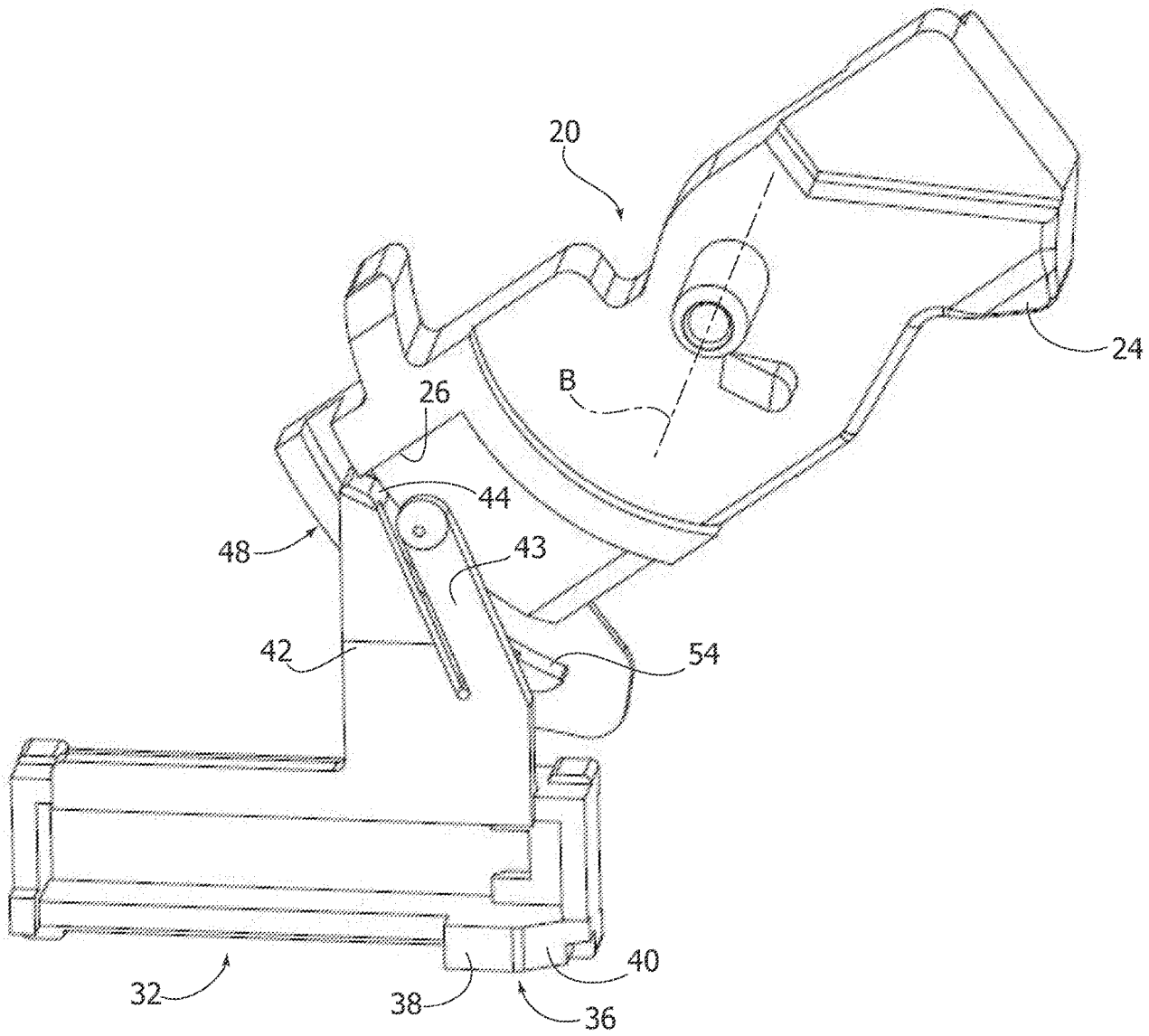

FIGS. 1 and 5 show the door-lock 10 in the configuration in which the door appliance is open. In this configuration the cam 16 is in the release position and the locking slider 20 is in the unlocking position. The cam 16 is free to rotate about the first axis of rotation A. The projection 44 of the door sensing slider 32 engages the first side surface 54 of the retaining portion 48 as shown in FIG. 5 and keeps the door sensing slider 32 in the open door position against the action of the spring 34 which tends to bias the door sensing slider 32 towards the closed door position. The door sensing pin 46 abuts on the top surface 38 of the abutment portion 36. Accordingly, the door sensing pin 46 is in the raised position and keeps the door sensing switch in an open state.

During closing of the door appliance, the hook 15 engages the cam 16 and causes the cam 16 to rotate about the axis A from the release position to the retaining position, as shown in FIG. 2. When the cam 16 is in the retaining position, the locking slider 20 rotates about axis B in clockwise direction under the force of the spring 22 from the unlocking position of FIG. 1 to the locking position of FIG. 2.

Figure 6:
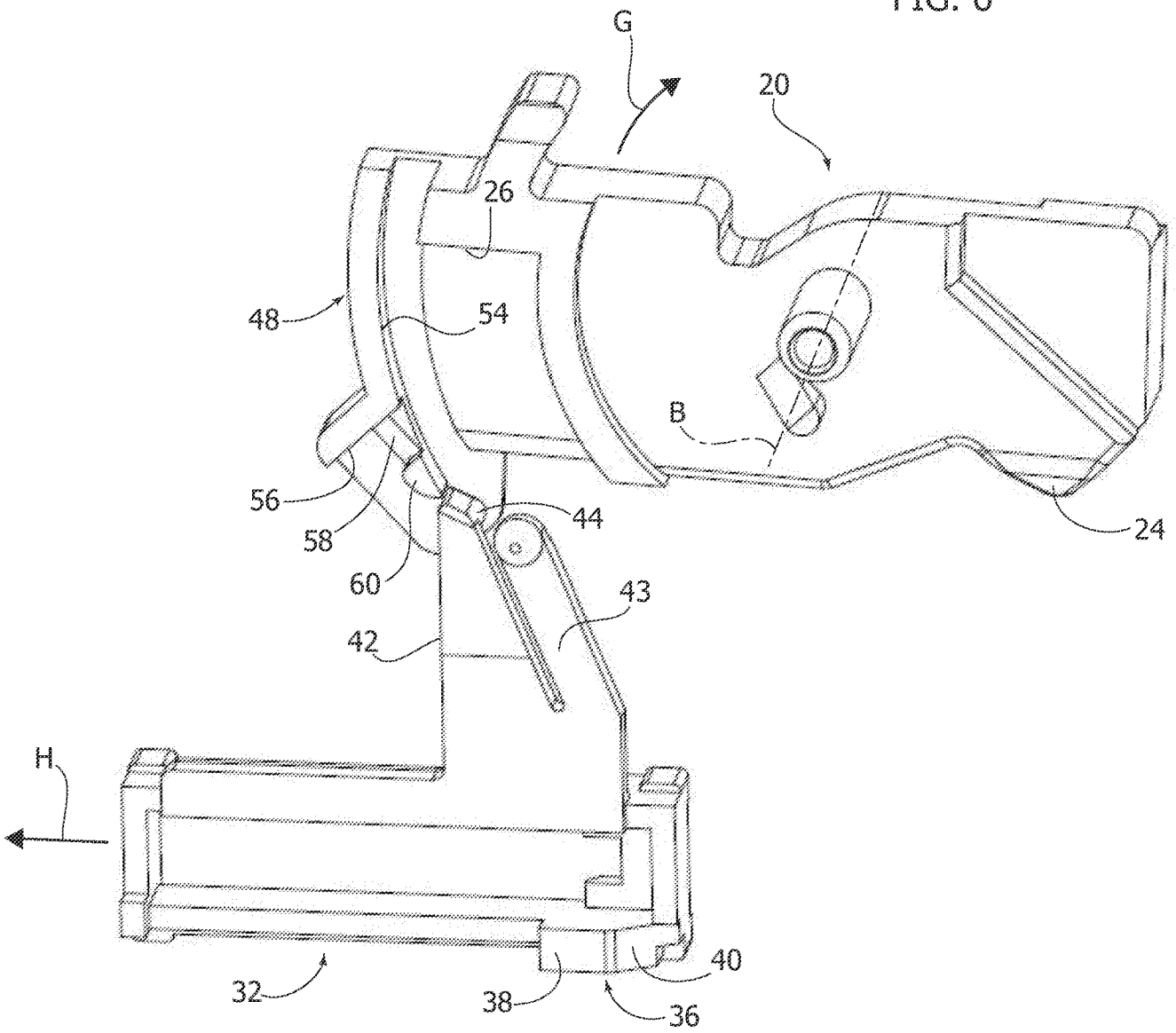

A shown in FIG. 6, the rotation of the locking slider 20 in clockwise direction G disengages the projection 44 of the door sensing slider 32 from the first side surface 54. When the projection 44 is disengaged from the first side surface 54 the door sensing slider 32 starts moving in the direction indicated by the arrow H in FIG. 6 towards the closed door position under the elastic force of the spring 34.

Figure 7:
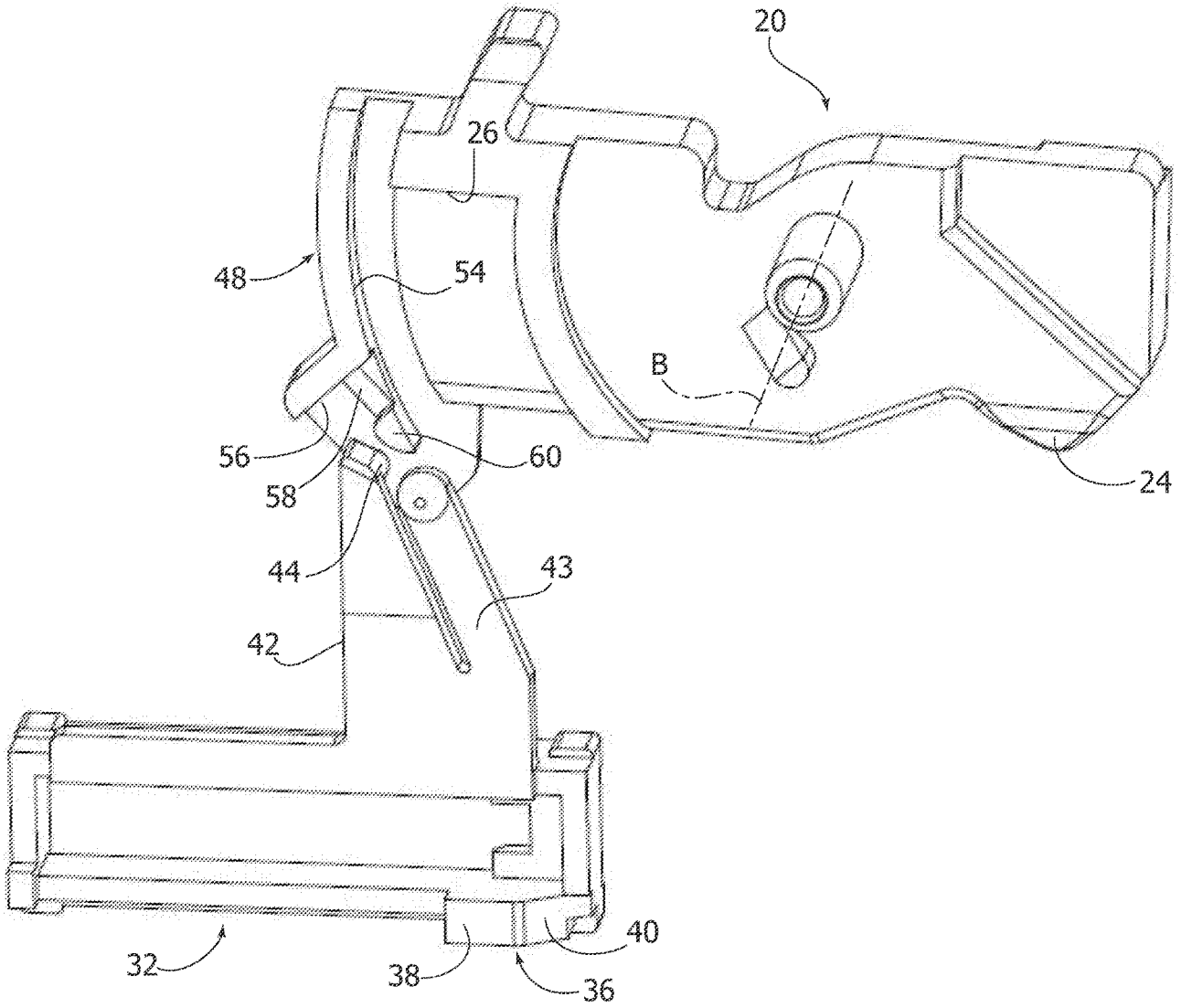

FIGS. 2 and 7 show the closed door configuration. The locking slider 20 is in the locking position and locks the cam 16 in the retaining position. The door sensing slider 32 is in the closed door position. The projection 44 of the door sensing slider 32 is disengaged from the first and second side surface 54, 56. The door sensing pin 46 is in the lowered position and the door sensing switch is closed. The locking pin 28 is in the locking position and engages the second locking portion 26 of the locking slider 20.

At the end of a washing cycle, the locking pin 28 is disengaged from the second lock portion 26 of the locking slider 20, so that the locking slider 20 is free to rotate about axis B and the cam 16 is free to rotate about axis A.

When the appliance door is pulled open, the hook 15 moves away from the casing 12 and causes the cam 16 to rotate from the retaining position to the release position. The rotation of the cam 16 from the retaining position to the release position causes rotation in counter-clockwise direction of the locking slider 20 from the locking position to the unlocking position.

Figure 8:
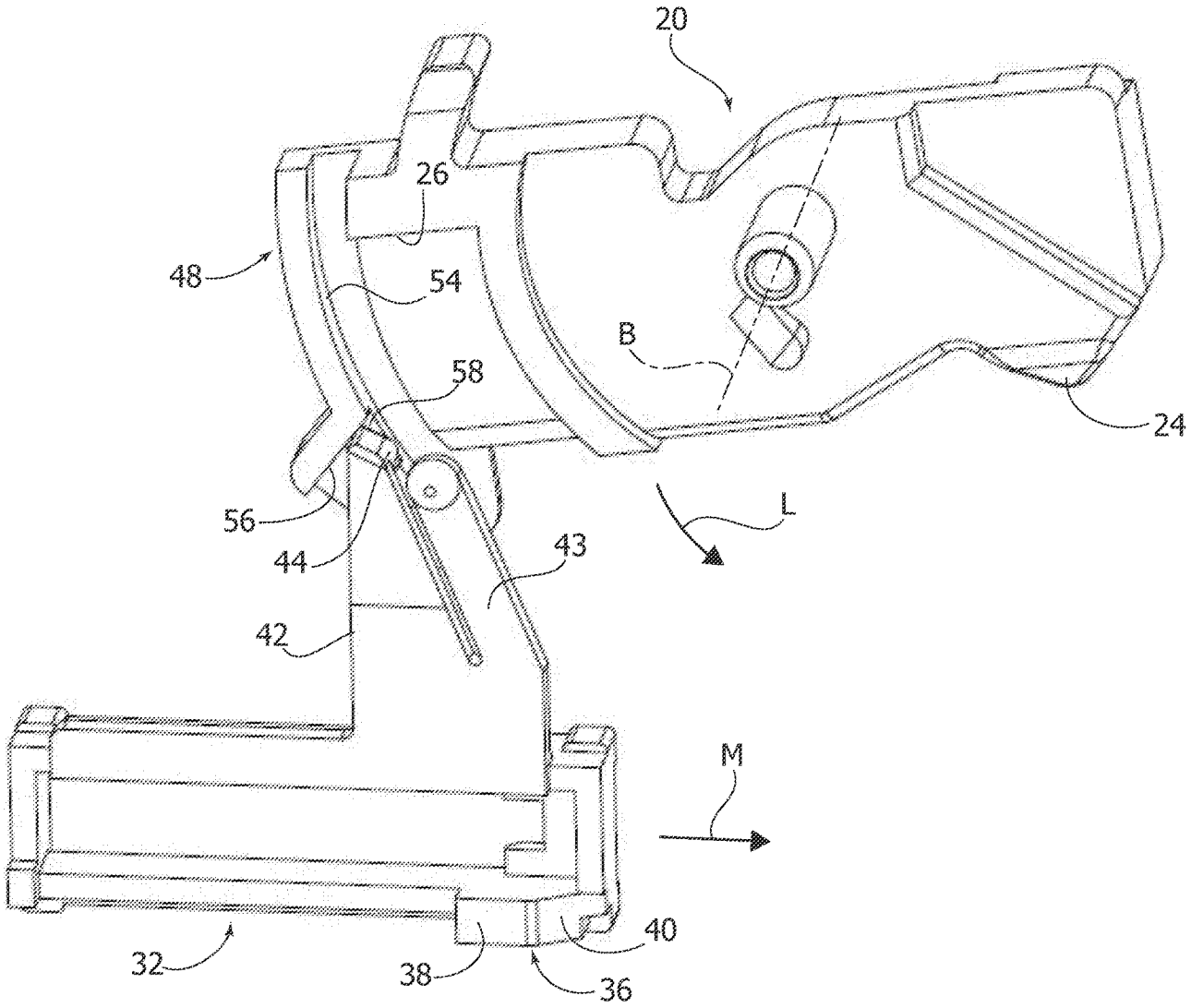

With reference to FIGS. 7 and 8, counter-clockwise rotation of the locking slider 20 from the locking position to the unlocking position brings the second side surface 56 of the locking slider 20 in contact with the projection 44 of the door sensing slider 32. As shown in FIG. 8, when the locking slider 20 rotates in the direction L the second side surface 56 abuts against the projection 44 and causes movement of the door sensing slider 32 in the direction M from the closed door position towards the open door position. When the projection 44 is climbing up on surface 58, the door sensing slider 32 is lifted up and the elastically deformable portion 43 deforms. When the projection 44 reaches the top of the inclined ramp 58, the door sensing slider is pushed downwards by the elastic force of the elastically deformable portion 43 and the projection 44 snaps into engagement with the first side surface 54.

The projection 44 follows different paths during door opening and door closing. Accordingly, the door sensing device 30 detects in a differentiated manner the open/closed state of the door during closing and opening the door. More specifically, the change from closed door state to open door state during opening of the door is detected by the door sensing pin 46 in a first position of the door, whereas the change from open door state to closed door state is detected by the door sensing pin 46 in a second position of the door, which is different from the first position. Therefore, detection of the change of state of the door occurs with a certain hysteresis during opening/closing of the door, as required by the appliance manufacturers.

The invention claimed is:

1. A door-lock for household appliances, comprising:

a casing having an opening for the insertion of a hook carried by a door of a household appliance, a cam rotatable relative to the casing about a first axis between a retaining position and a release position, wherein in the retaining position the cam is adapted to lock the hook in a closed door position, a locking slider cooperating with the cam and movable between an unlocking position and a locking position, wherein in the locking position the slider locks the cam in the retaining position, a locking pin for locking the locking slider in the locking position, a door sensing slider movable between an open door position and a closed door position, the door sensing slider having an abutment portion including a top surface and an inclined surface, a door sensing pin elastically biased against the abutment portion of the door sensing slider, wherein in the open door position of the door sensing slider the door sensing pin is in contact with the top surface and in the closed door position of the door sensing slider the door sensing pin is in contact with the inclined surface, and wherein:

the locking slider has an integral retaining portion cooperating with a projection of an arm of the door sensing slider, the retaining portion has a first and a second side surface which define different paths for the projection during door opening and door closing, the change from closed door state to open door state during opening of the door is detected by the door sensing pin in a first position of the door, and the change from open door state to closed door state is detected by the door sensing pin in a second position of the door, which is different from the first position.

2. The door-lock of claim 1, wherein the first side surface and the second side surface extend between a bottom surface and a top surface, the second side surface extending radially from the first side surface.

3. The door-lock of claim 2, wherein the retaining portion comprises an inclined ramp which connects the bottom surface to the first side surface.

4. The door-lock of claim 3, wherein the inclined surface set between the second side portion and a rounded surface which projects from the bottom surface at an end of the first side surface.

5. The door-lock of claim 3, wherein the arm comprises an elastically deformable portion which deforms elastically when the projection moves on the inclined ramp.

6. A door-lock for household appliances, comprising:

a casing having an opening for the insertion of a hook carried by a door of a household appliance, a cam rotatable relative to the casing about a first axis between a retaining position and a release position, wherein in the retaining position the cam is adapted to lock the hook in a closed door position, a locking slider movable between an unlocking position and a locking position so that the locking slider locks the cam in the retaining position when the locking slider is in the locking position, the locking slider including:

a top surface;

a retaining portion extending from top surface, with the locking slider retaining portion defining;

a first side surface extending from the locking slider top surface;

a second side surface extending from the locking slider top surface;

a door sensing slider movable between an open door position and a closed door position, the door sensing slider:

being movable relative to the locking slider and between an open door position and a closed door position;

having an arm with an arm projection;

wherein:

during door opening and door closing events, the arm projection engages and moves along different movement paths relative to the first and second side surfaces of the retaining portion of the locking slider.

7. The door-lock of claim 6, wherein:

the retaining portion of the locking slider includes an inclined ramp; and during one of the door opening and door closing events, the arm projection slides up the inclined ramp and lifts at least a portion of the door sensing slider away from the locking slider.

8. The door-lock of claim 7, wherein:

during one of the door opening and door closing events, the arm projection slides up the inclined ramp to a maximum height position on the included ramp and further movement of the door during one of the door opening and door closing events moves the arm projection beyond the maximum height position and off the ramp, whereby the door sensing slider moves toward the locking slider.

9. The door-lock of claim 8, wherein:

the arm of the door sensing slider includes a deformable portion that:

elastically deforms from a resting position while the arm projection slides up the inclined ramp; and restores toward the resting position and biases the door sending slider toward the locking slider when the arm projection moves beyond the maximum height position and off the ramp.

* * * * *